313-422 SR
8/5/80 OR 4,216,407

United States Patent [19]
Vaccaro

[11] 4,216,407
[45] Aug. 5, 1980

[54] FLAT PANEL DISPLAY DEVICE WITH BEAM COLLECTOR

[75] Inventor: Frank E. Vaccaro, East Brunswick, N.J.

[73] Assignee: RCA Corporation, New York, N.Y.

[21] Appl. No.: 956,663

[22] Filed: Nov. 1, 1978

[51] Int. Cl.[2] ..... H01J 29/08; H01J 29/56
[52] U.S. Cl. ..... 313/422
[58] Field of Search ..... 313/422

[56] References Cited

U.S. PATENT DOCUMENTS

| | | | |
|---|---|---|---|
| 2,830,226 | 4/1958 | Aiken | 313/422 |
| 3,453,482 | 7/1969 | Preist | 315/5.29 |
| 4,069,439 | 1/1978 | Anderson | 313/422 |
| 4,075,535 | 2/1978 | Genequand et al. | 313/422 |
| 4,088,920 | 5/1978 | Siekanowicz et al. | 313/422 |
| 4,121,137 | 10/1978 | Credelle | 315/366 |
| 4,126,814 | 11/1978 | Marlowe | 315/307 |

*Primary Examiner*—Robert Segal
*Attorney, Agent, or Firm*—E. M. Whitacre; G. H. Bruestle; L. L. Hallacher

[57] ABSTRACT

An evacuated envelope includes spaced substantially parallel front and back walls, and a plurality of spaced, parallel support walls between the front and back walls and forming a plurality of channels. An electron gun structure at one end of the channels directs at least one beam of electrons into each channel. In each channel is a focusing guide comprising at least two substantially parallel guide grids which confine the electrons into a beam. At the end of the focusing guide opposite the gun structure is a beam collector structure which collects the beam and subsequently generates a signal which is processed and used to adjust the uniformity characteristics of each beam.

13 Claims, 5 Drawing Figures

FLAT PANEL DISPLAY DEVICE WITH BEAM COLLECTOR

BACKGROUND OF THE INVENTION

The present invention relates to image display devices having a plurality of electron beams each of which scans a different portion of the display, and more particularly to a beam collector which collects and senses the beam current. The beam current information is processed and used to adjust the uniformity characteristics of the electron beams to obtain uniform brightness across the entire screen of the display device.

Beam collectors, such as the so-called "Faraday Cage"-type, designed so that the total current is collected and secondary electrons which are generated are not permitted to escape to other tube elements, are well known in the power tube art. A high power beam tube utilizing a "Faraday Cage"-type beam collector is described in U.S. Pat. No. 3,453,482 entitled "Efficient High Power Beam Tube Employing a Fly-Trap Beam Collector Having a Focus Electrode Structure at the Mouth Thereof", issued on July 1, 1969, to D. H. Preist. One of the problems encountered with such a collector is that complex and costly focusing electrode structure at the mouth of the collector is required for focusing the beam in the decelerating space preceding the mouth of the collector to maintain laminar flow of the electrons in the beam decelerating region. Such focusing structure prevents the setting up of excessive space charge depressions in the deceleration region which would inhibit collection of the total beam current. For such collectors to be practical in display devices, they should utilize as much of the existing device structure as possible to focus the beam while achieving substantially total collection of the electron beam, and either total collection or suppression of secondary and scattered electrons generated by the impingement of the electron beam onto the collector.

U.S. Pat. No. 4,126,814 of Frank J. Marlowe, filed Dec. 9, 1976, entitled "Electron Gun Control System", and U.S. Pat. No. 4,121,137 of Thomas L. Credelle issued Oct. 17, 1978, entitled "System for Achieving Image Uniformity in Display Devices" disclose systems which include collecting the electron beams and sensing their current magnitudes. The Marlowe application does not detail the structure of the collector. The Credelle patent states only that the collectors are U-shaped electrodes located between the focusing guide at the end of the channels.

The present invention is directed to a simple collector structure within the guide, which utilizes existing display device elements modified to provide high collection efficiency and to prevent the escape of secondary and scattered electrons to other tube elements.

SUMMARY OF THE INVENTION

A display device has an evacuated envelope, a phosphor screen, a plurality of guide means and an electron generating and directing means at one end of the guide means. Each guide means comprises a pair of elongated guide grids for focusing and guiding a plurality of electron beams in paths substantially parallel to the screen. At the other end of the guide means is an electron beam collector means comprising a beam collecting pad substantially parallel to and spaced from the screen on the side of the beam path plane opposite the screen, and a shielding means extending from the guide means between the screen and the pad.

DETAILED DESCRIPTION OF THE PREFERRED EMBODIMENT

Figure 1:
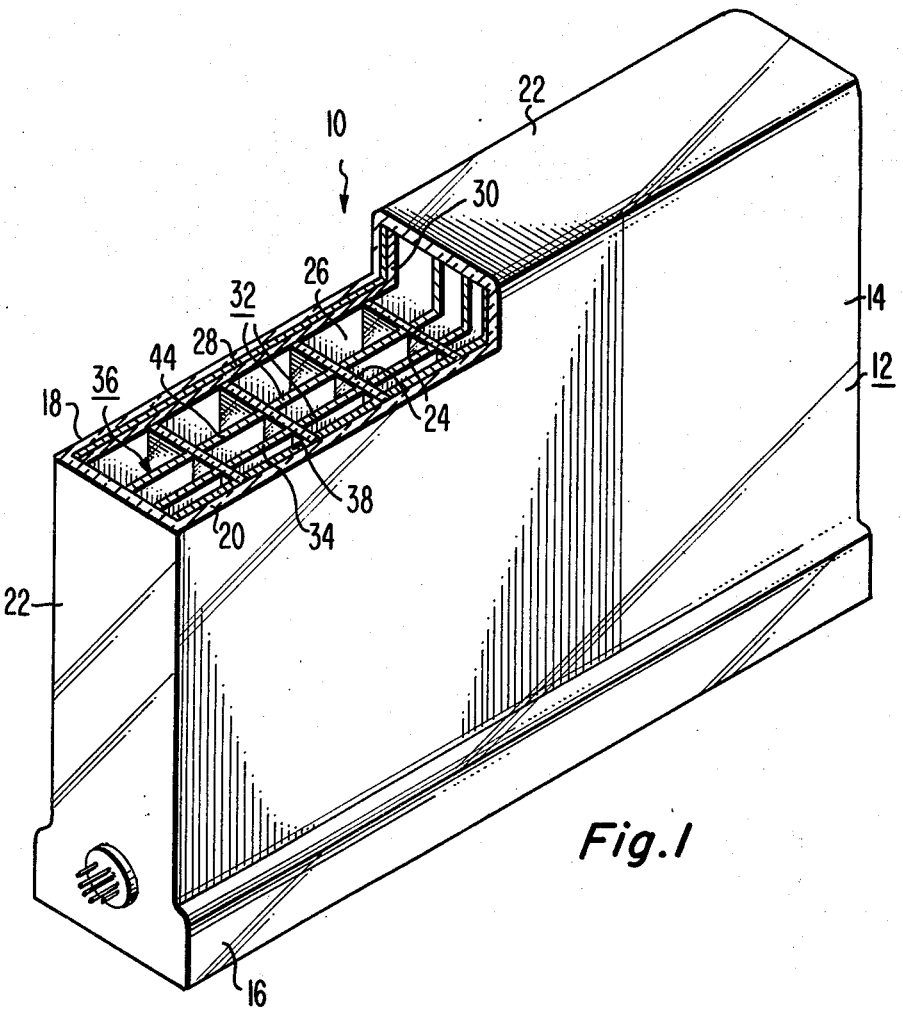
FIG. 1 is a perspective view, partially cut-away, of a flat display device into which the present invention may be embodied.

Referring to FIG. 1, one form of a flat display device which can utilize the beam collector of the present invention is generally designated as 10. The display device 10 comprises an evacuated envelope 12, typically of glass, having a display section 14 and an electron gun section 16. The display section 14 includes a rectangular front wall 18 which supports a viewing screen 28 and a rectangular back wall 20 in spaced, parallel relation with the front wall 18. The front wall 18 and back wall 20 are connected by side walls 22. The front wall 18 and back wall 20 are dimensioned to provide the size of the viewing screen desired, e.g., 75 by 100 cm, and are spaced apart above 2.5 to 7.5 cm.

A plurality of spaced, parallel support walls 24 are secured between the front wall 18 and the back wall 20 and extend from the gun section 16 to the opposite side wall 22. The support walls 24 provide the desired internal support for the evacuated envelope 12 against external atmospheric pressure and divide the display section 14 into a plurality of channels 26. On the inner surface of the front wall 18 is the phosphor screen 28. The phosphor screen 28 may be of any well known type presently being used in cathode ray tubes, e.g., black and white or color television display tubes. A metal film electrode 30 is provided on the phosphor screen 28.

The gun section 16 is an extension of the display section 14 and extends along one set of adjacent ends of the channels 26. The gun section may be of any shape suitable to enclose a particular gun structure contained therein. The electron gun structure contained in the gun section 16 may be of any well known construction suitable for selectively directing at least one beam of electrons into each of the channels 26. For example, the gun structure may comprise a plurality of individual guns mounted at the ends of the channels 26 for directing separate beams of electrons into the channels. Alternatively, the gun structure may include a line cathode extending along the gun section 16 across the ends of the channels 26 and adapted to selectively direct individual beams of electrons into the channels. A gun structure of the line type is described in U.S. Pat. No. 2,858,464 to W. L. Roberts, issued Oct. 28, 1958, entitled "Cathode Ray Tube".

In each of the channels 26 is a focusing guide 32 for focusing and periodically confining electrons into a beam which travels a path lying in a beam path plane along the channel. Each guide also includes means for deflecting the beam out of the guide and toward the phosphor screen 28 at various points along the length of the channel 26.

Figure 2:
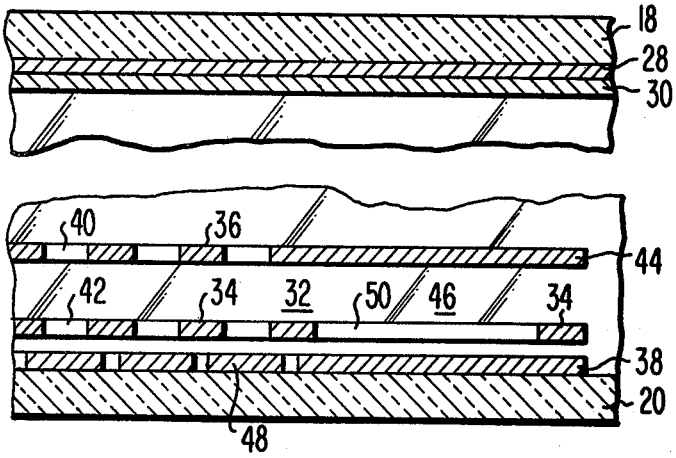
FIG. 2 is a longitudinal sectional view of the focusing guide showing a beam collector.

Referring to FIG. 2, there is shown one form of a collector structure 46 substantially within the focusing guide 32 opposite the electron gun section 16 (not shown). The focusing guide 32 includes an upper guide grid 36 and a lower guide grid 34 extending longitudinally along and transversely across the channels 26. The upper and lower guide grids 36 and 34 are secured together in spaced apart, parallel relation as disclosed in U.S. Pat. No. 4,101,802, by Zygmunt M. Andrevski, issued July 18, 1978, entitled "Flat Display Device with Beam Guide." The upper guide grid 36 has a plurality of spaced, substantially rectangular apertures 40 therethrough. The apertures 40 are arranged in rows both longitudinally along and transversely across the channels 26. The lower guide grid 34 has a plurality of spaced, substantially rectangular first apertures 42 and a transverse row of spaced, enlarged, substantially rectangular second apertures 50. The apertures 42 are arranged in rows both longitudinally along and transversely across the channels 26 with each of the apertures 42 being aligned with a different one of the apertures 40 in the upper guide grid 36. The second apertures 50 are adjacent to but spaced from the first apertures 42 and are located longitudinally opposite the electron gun section 16 (not shown). A plurality of spaced, parallel conductors 48 are disposed on the inner surface of the back wall 20 and extend transversely across the channels 26. The conductors 48 are strips of an electrically conductive material, such as metal, coated on the back wall 20. Each of the conductors 48 lies directly opposite a transverse row of first apertures 42 in the lower guide grid 34.

The collector structure 46 located substantially within the focusing guide 32 comprises a non-apertured shielding member 44 which is a coplanar extension of the upper guide grid 36. The collector structure includes a beam collecting electrode pad 38 of an electrically conductive material, such as metal, coated on the back wall 20, on the side of the beam path plane opposite the screen 28. The collector structure may also include a section of the lower guide grid 34 having a row of second apertures 50. The non-apertured shielding member 44 projects longitudinally above the second apertures 50 of the lower guide grid 34, and extends transversely across the channel 26 so as to substantially shield the electrode pad 38 from the metal film electrode 30 on the phosphor screen 28. The collecting electrode pad 38 is substantially coextensive with the row of second apertures 50 and with the shielding member 44, and extends transversely across the electron beam path in each of the channels 26. It is also possible to construct a collector without a row of second apertures 50 by terminating the lower guide grid 34 after the last row of first apertures 42.

When the display is turned on but before the image is to be displayed, the electron beams generated in the gun section 16 (not shown) impinge on the beam collecting electrode pad 38 which senses the resulting electron current by means of a current sensing resistor (not shown). The resulting current is fed to an electron gun control system for controlling each of the electron beams to obtain uniform brightness across the entire screen of the display. Such a control system is disclosed and described in U.S. Pat. No. 4,126,814 entitled "Electron Gun Control System" filed Dec. 9, 1976, by Frank J. Marlowe. Brightness uniformity control signals may also be generated periodically during the vertical retrace of the display to update the control system by permitting the electron beam to impinge on the collecting electrode pad 38.

In order to obtain a true measure of the electron current, collector structure 46 is designed so that substantially all the current is collected and secondary and scattered electrons that are generated by the electron beam impinging on the pad 38, are not permitted to escape to other tube elements. For such a collector to work well, it is necessary that the transition region between the focusing guide 32 and the collector structure 46 be designed for high beam transmission and for the absence of stray electric fields which would prevent collection of the total beam current. The novel collector provides an efficient structure by extending the non-apertured section of the upper guide grid 36 beyond the active phosphor screen area, by providing a transverse row of enlarged apertures 50 at the end of the lower guide grid 34 longitudinally opposite the electron gun section 16 (not shown), and by adding the collecting electrode pad 38 to the back wall 20 below the shielding member 44 of the upper guide grid 36.

In the operation of the display device 10, a positive potential, typically about 80 volts, is applied to the upper and lower guide grids 36 and 34 and to the shielding member 44 of the focusing guide 32. A relatively high positive potential, typically about 300 volts, is applied to each of the conductors 48 of the focusing guide 32 and to the beam collecting electrode pad 38. A high positive potential, typically 2000 to 8000 volts is applied to the metal film electrode 30 on the phosphor screen 28. Beams of electrons are directed along a path from the gun section 16 into the channels 26 between the guide grids 34 and 36 of the focusing guide 32, with each beam being directed along a longitudinal row of guide grid apertures 40 and 42. As described in the previously referred to patent of A. M. Andrevski, the potential difference between the focusing guide 32 and the conductors 48 and the potential difference between the focusing guide 32 and the metal film 30 of the phosphor screen 28 creates an electrostatic forced field within the space between the guide grids 34 and 36 as described in U.S. Pat. No. 4,088,920 issued on May 9, 1978, to W. W. Siekanowicz et al. This electrostatic field applies forces to confine the electrons into beams which result in a periodic compression of the beams as the beams travel along a substantially straight path between the guide grids 34 and 36. The beams can be selectively deflected out of the guide 32 toward the phosphor screen 28 at each of the transverse rows of the grid plate apertures 40 and 42 to achieve a line-by-line raster scan of the phosphor screen by selectively switching the potential applied to each of the conductors 48 to a negative potential, such as −100 volts, or the beams may travel undeflected through the guide 32 and enter the collector structure 46 as a focused unperturbed beam. The beam is attracted to the collecting electrode pad 38, through the second aperture 50, by a positive potential, typically +300 V, applied to the electrode pad 38. The electrode pad 38 is shielded by shielding member 44 from the high positive potential on metal film electrode 30. A beam impinging upon the collecting electrode pad 38 generates a current signal which is processed by the gun control system described in copending U.S. Application of Marlowe referred to above.

Since the collector structure 46 is within the focusing guide 32 and utilizes many of the existing device elements, namely, the shielding member 44, the collecting electrode pad 38, and the second apertures 50 of the lower guide grid 34 as described above, no additional focusing structure is required as in "Faraday Cage"-type collector for focusing the beam in transition region between the focusing guide 32 and the collector 46. The elimination of additional focusing structure which creates stray electric fields in the transition region proceeding the collector structure 46 in the present invention, permits high beam transmission into the collector structure 46 and thus permits collection of substantially all of the beam current.

Electron beams which travel in stable trajectories in a periodic focusing structure, such as the focusing guide 32, exhibit a wavelength periodicity. A wavelength period is defined as the distance an electron travels from a particular position and angle relative to the longitudinal axis of the electron path of travel until it reaches substantially the same relative position and angle with respect to the axis. In the display device discussed herein, a wavelength period hereafter called a period is 0.120 inches (about 3.05 mm). Every element of the collector structure 46 including the shielding member 44, the collecting electrode pad 38, and the second apertures 50 of the lower guide grid 34 has a longitudinal dimension of at least one period and preferably three to four periods.

Typical dimensions for the focusing guide 32 and the collector structure 46 are as follows:

- Thickness of each of the guide grids=0.003 inches (about 0.076 mm)
- Distance between guide grids=0.050 inches (about 1.27 mm)
- Distance between lower guide grid and back wall=0.020 inches (about 0.051 mm)
- Longitudinal dimension of the first aperture=0.072 inches (about 1.83 mm)
- Longitudinal dimension of the second aperture=0.400 inches (about 10.16 mm)
- Longitudinal dimension of collector electrode=0.475 inches (about 12.07 mm)
- Longitudinal dimension of shielding member=0.475 inches (about 12.07 mm)
- Length of one period=0.120 inches (about 3.05 mm)
- Transverse dimension of first and second apertures=0.176 inches (about 4.47 mm)

To improve the collection efficiency of the collector electrode pad 38 a secondary electron inhibiting material (not shown), such as carbon or gold, may be deposited on the surface of the collector electrode pad 38. While other materials may be more efficient than gold as an electron inhibiting material, gold has the advantages of high purity and contamination resistance which makes it a desirable material to use.

Figure 3:
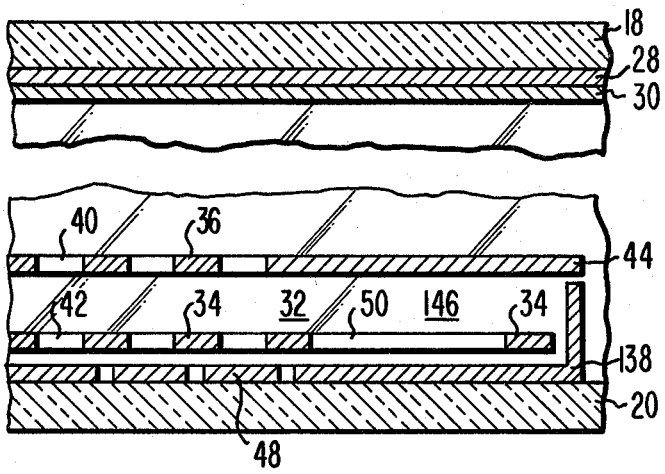
FIG. 3 is a longitudinal sectional view of a modification of the collecting electrode pad.

Referring to FIG. 3, there is shown a modified collector structure 146 including a modified collecting electrode pad 138 which can be used in the display device 10. The collector structure 146 is substantially identical to the collector structure 46 shown in FIG. 2, with the exception that a substantially perpendicular projection has been added to the collecting electrode pad 138 at the end opposite the electron gun section 16 (not shown). The projection on collecting electrode pad 138 is longitudinally located along the channel 26 beyond the lower guide grid 34 in order to improve collection efficiency and to decrease the scattering of secondary electrons to other elements of the device. The vertical projection may be made of any suitable conductive material, such as copper. The thickness of the projection is substantially identical to the thickness of the upper guide grid 36. The projection extends transversely across each of the channels and extends vertically to within approximately 0.006 inches (about 0.152 mm) of the shielding member 44.

In the operation of the display device 10, incorporating the above-described collecting electrode pad 138, the voltages applied and the mode of operation is substantially identical to that previously described for the collector structure 46 shown in FIG. 2. As shown in FIG. 3, the electron beam, focused and confined between the upper and lower guide grids 36 and 34, enters the collector structure 146 and is attracted to the collecting electrode pad 138, through the second apertures 50, by the positive potential, typically +300 V, applied to the electrode pad 138. The electron beam impinges on the horizontal surface of the collecting electrode pad 138 and the secondary and scattered electrons which are generated impinge upon and are collected by the horizontal surface and the vertical projection of the collecting electrode pad 138. A current is generated by means of a current sensing resistor (not shown) and is processed by the electron gun control system as discussed above.

Figure 4:
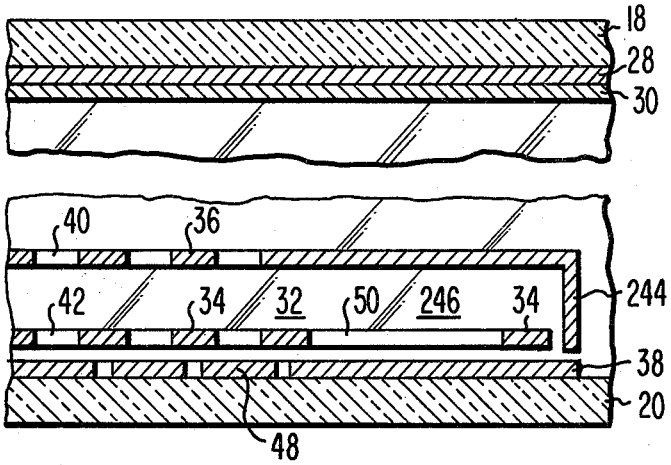
FIG. 4 is a longitudinal view of a modification of the non-apertured shielding member.

Referring to FIG. 4, there is shown a modified collector structure 246 including a shielding member 244 which can be used in the display device 10. The collector structure 246 is substantially identical to the collector structure 46 shown in FIG. 2, with the exception that a substantially perpendicular projection is included in the shielding member 244 at the end opposite the electron gun structure 16 (not shown) to decrease the scattering of secondary electrons to other elements in the device. The projection may be made of any suitable conductive material, such as cold rolled steel. The thickness of the projection is substantially identical to the thickness of the upper guide grid 36. The projection extends transversely across the channel having a width substantially equal to the width of the upper guide grid 36. The projection extends vertically downward to within 0.006 inches (about 0.152 mm) of the collecting electrode pad 38 and extends longitudinally along the channel 26 beyond the lower guide grid 34.

In the operation of the display device 10 incorporating the above-described shielding member 244, the voltages applied and the mode of operation is substantially identical to that previously described for the collector structure 46 shown in FIG. 2. As shown in FIG. 4, the electron beam, focused and confined between the upper and lower guide grids 36 and 34, enters the collector structure 246 and is attracted to the collecting electrode pad 38 through the second aperture 50, by the positive potential, typically +300 V, applied to the electrode pad 38. The electron beam impinges on the collecting electrode pad 38 and the secondary and scattered electrons which are generated impinge upon the horizontal surface of the collecting electrode pad 38 and are collected, or the electrons impinge upon the downward projection of the shielding member 244 and are prevented from scattering to other elements of the display. Secondary and scattered electrons which, in this modification, impinge upon the shielding member 244 do not contribute to the total electron current. Beam collection efficiency may be improved in this collector structure 246 by applying a secondary electron inhibiting material, (not shown), such as carbon or gold, to the collecting electrode pad 38.

Figure 5:
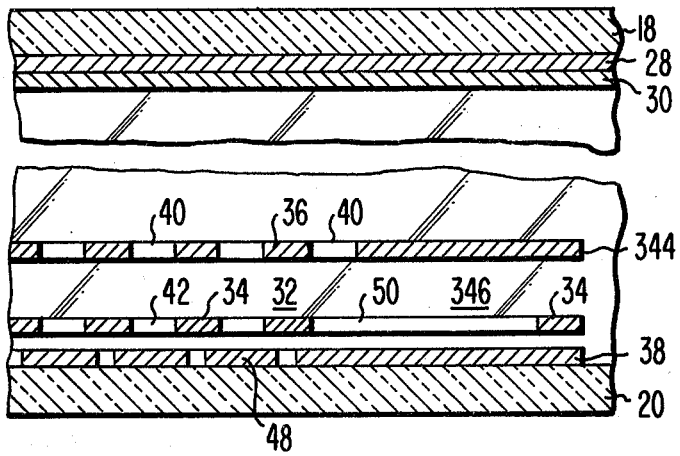
FIG. 5 is a longitudinal view of another modification of the shielding member.

Referring to FIG. 5, there is shown another collector structure 346 wherein the shielding member 34 is modified by an additional transverse row of first apertures 40 which are substantially aligned with the one end of the second apertures 50 of the lower guide grid 34 at the entrance to the collector structure 346.

In the operation of the display device 10 incorporating the above-described collector structure 346, the voltages applied and the mode of operation is substantially identical to that previously described for the collector structure 46 shown in FIG. 2. As shown in FIG. 5, an electron beam, focused and confined between the upper and lower guide grids 36 and 34, undergoes a final focusing force exerted through the additional row of apertures 40 in the shielding member 344 due to the potential difference between the focusing guide 32 and the metal film 30 on the phosphor screen 28. The refocused beam enters the collector structure 346 and is attracted to the collecting electrode pad 38 through the second apertures 50, by the positive potential, typically +300 V, applied to the collecting electrode pad 38. The electron beam impinges upon the collecting electrode pad 38 and the secondary and scattered electrons which are generated also impinge upon and are collected by the collecting electrode pad 38. To insure substantially total collection of the electron current, the collecting electrode pad 38 should have a longitudinal dimension of at least one period, and preferably three or four periods. Beam collection efficiency may also be improved by applying a secondary electron inhibiting material, (not shown), such as carbon or gold, to the collecting electrode pad 38 as discussed above.

In addition to the upper and lower guide grids 36 and 34 of the focusing guide 32 disclosed herein, the guide may also include a conductive focus grid (not shown) and a conductive acceleration grid (not shown) of the type described in the U.S. Pat. No. 4,028,582 entitled "Guided Beam Flat Display Device" issued June 7, 1977 to C. H. Anderson et al., and now reissue application Ser. No. 862,188 filed on Dec. 19, 1977. The focus grid is in spaced, substantialy parallel relation to the upper guide grid 36 on the side of the upper guide grid 36 toward the front wall 18. The acceleration grid is in spaced, substantially parallel relation to the focus grid on the side of the focus grid toward the front wall 18. Both the focus grid and the acceleration grid have a plurality of spaced, substantially rectangular first apertures which are essentially identical to and aligned with the first apertures 40 and 42 of the upper and lower guide grids 36 and 34.

In operation, anode potential, typically +2000 to +8000 volts is applied to the acceleration grid. A positive potential, higher than that applied to the upper and lower guide grids 36 and 34 but lower than that applied to the acceleration grid, is applied to the focus grid. The remaining voltages applied and the mode of operation is substantially identical to that previously described for the display device as shown in FIGS. 1–5.

I claim:

1. A display device comprising:

an evacuated envelope, a phosphor screen within said envelope, a plurality of guide means, each comprising a pair of elongated guide grids disposed substantially parallel to said screen for focusing and guiding a plurality of electron beams in paths lying in a beam path plane substantially parallel to said screen and including a plurality of extraction electrodes for deflecting said beams out of said plane and onto said screen to scan a raster on said screen, means at one end of said guide means for generating and directing said electron beams along said paths, and electron beam collector means disposed at the other end of said guide means, said collector means comprising a beam collecting pad substantially parallel to and spaced from said screen on the side of said plane opposite said screen, and shielding means extending from said guide means between said screen and said pad, said shielding means being substantially coextensive with said pad.

2. A display device in accordance with claim 1 wherein the shielding means is a non-apertured shielding member.

3. A display device in accordance with claim 2 wherein the shielding member has a substantially perpendicular projection directed toward but spaced from said beam collecting pad.

4. A display device in accordance with claim 1 wherein the beam collecting pad is a collecting electrode, such as metal.

5. A display device in accordance with claim 4, wherein said collecting electrode has a substantially perpendicular projection extending transversely across each of said channels and is directed toward but spaced from said shielding member.

6. In a display device which includes, an evacuated envelope having a phosphor screen adjacent to and substantially coextensive with a first inner surface of said envelope, a plurality of channels extending parallel to and across said first inner surface, means at one end of said channels for generating and directing electrons into each of said channels, and guide means in each of said channels having spaced, substantially parallel upper and lower guide grids, said grids having a plurality of apertures therethrough for focusing and periodically confining therebetween the electrons directed into the channel into a beam along a path, said guide means having one end adjacent to said electron generating and directing means, the improvement comprising a collector including, a beam collecting pad disposed in a plane parallel to said screen, said pad being adjacent to a second inner surface of said envelope opposite said screen, said pad extending transversely across said guide means for collecting the electron beam exiting from said guide means opposite said generating and directing means, and shielding means extending from said upper guide grid along the beam path, said shielding means being disposed between said screen and said path, said shielding means being substantially coextensive with said pad.

7. A display device in accordance with claim 6, wherein the beam collecting pad is a collecting electrode, such as metal, coated on said second inner surface of said envelope.

8. A display device in accordance with claims 4, wherein said collecting electrode is coated with a material which will inhibit the production of secondary electrons.

9. A display device in accordance with claim 8, wherein said inhibiting material is selected from the group consisting of carbon and gold.

10. A display device in accordance with claim 6, wherein the shielding means is a non-apertured shielding member.

11. A display device in accordance with claim 10 wherein said shielding member has a substantially perpendicular projection directed toward but spaced from said beam collecting electrode, said projection extending longitudinally beyond the end of said lower guide grid opposite said electron generating and directing means.

12. A display device in accordance with claim 10 wherein said beam collecting electrode has a substantially perpendicular projection extending transversely across each of said channels and directed toward but spaced from said shielding member, said projection extending longitudinally beyond the end of said lower guide grid opposite said electron generating and directing means.

13. A display device in accordance with claim 6 wherein said shielding member has a transverse row of apertures therethrough, identical to the apertures in said upper and lower guide grids, so that the electron beam is focused within said collector.

* * * * *